US009109448B2

(12) United States Patent
Ivakitch et al.

(10) Patent No.: US 9,109,448 B2
(45) Date of Patent: Aug. 18, 2015

(54) GROMMET FOR GAS TURBINE VANE

(75) Inventors: Richard Ivakitch, Toronto (CA); Andreas Eleftheriou, Woodbridge (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 613 days.

(21) Appl. No.: 13/428,720

(22) Filed: Mar. 23, 2012

(65) Prior Publication Data

US 2013/0251517 A1 Sep. 26, 2013

(51) Int. Cl.
*F01D 25/00* (2006.01)
*F01D 9/04* (2006.01)

(52) U.S. Cl.
CPC ..... *F01D 9/042* (2013.01)

(58) Field of Classification Search
CPC ..... F01D 9/042
USPC ..... 415/191, 209.1–209.4, 210.1, 211.2; 416/215–218, 220 R, 248
See application file for complete search history.

(56) References Cited

U.S. PATENT DOCUMENTS 2,957,228 A 10/1960 Stoddard et al.
5,074,752 A * 12/1991 Murphy et al. ..... 415/209.4
5,411,370 A 5/1995 Varsik
5,494,404 A 2/1996 Furseth et al.
5,547,342 A * 8/1996 Furseth et al. ..... 415/200
5,839,878 A 11/1998 Maier
6,619,917 B2 9/2003 Glover et al.
7,311,495 B2 12/2007 Ashley et al.
7,413,400 B2 8/2008 Barnett
7,530,782 B2 5/2009 Barnett et al.
7,637,718 B2 12/2009 Barnett et al.
2006/0067817 A1 * 3/2006 Motherwell et al. ..... 415/191
2006/0288687 A1 * 12/2006 Bruno et al. ..... 60/226.1
2012/0070270 A1 * 3/2012 Ravey et al. ..... 415/119

* cited by examiner

*Primary Examiner* — Nathaniel Wiehe
*Assistant Examiner* — Woody A Lee, Jr.
(74) *Attorney, Agent, or Firm* — Norton Rose Fulbright Canada LLP

(57) ABSTRACT

A vane assembly for a gas turbine engine includes an annular shroud having openings therein and a plurality of vanes extending radially from the shroud and each having an extremity received within one of the openings. A grommet is positioned within each opening for shielding the vane extremity from the annular shroud. The grommet includes an annular protrusion for providing sealing between the opening and the vane extremity, and an annular restraint element adjacent the protrusion for retaining the vane in place relative to the shroud.

18 Claims, 6 Drawing Sheets

GROMMET FOR GAS TURBINE VANE

TECHNICAL FIELD

The present disclosure relates generally to gas turbine engines, and particularly to vane assemblies therefor.

BACKGROUND

Gas turbine engine vane assemblies are usually provided downstream of the engine fan and/or of a low pressure compressor to reduce the swirl in the air flow entering the high speed compressor. Such guide vane assemblies must be resistant to foreign object damage while having a minimal weight.

It is known to provide a vane shroud with slots receiving an extremity of the vane in order to retain the vane in place therewithin. In such a configuration, a grommet is inserted in the slots such as to surround the vane thereby isolating the vane from the shroud. However, a foreign object damage event can damage the grommet and damage to other surrounding components. The use of alternatives to maintain vane components in place, such as adhesives, complicates the installation and replacement of vanes. In some engines, an annular attachment strap may also be used to provide a radial load on the stator vanes and grommets. Friction around a circumference of the strap may however lead to uneven or Improper loading thereof, which can result in undesirable leakage.

Accordingly, there is a need to provide an improved vane assembly.

SUMMARY

There is provided a vane assembly comprising: an annular shroud having radially spaced apart inner and outer surfaces, said shroud having a plurality of openings extending between said inner and outer surfaces; a plurality of vanes radially extending from said shroud, each vane having an extremity received within a corresponding one of said openings; and a grommet located within each of said openings between each of said vanes and said shroud, said grommet defining a radially extending bore along a central axis thereof adapted to receive said vane extremity therein, the grommet shielding said vane extremity from said shroud, said grommet having formed therein an annular protrusion in contact with a perimeter of said opening in the shroud to form a circumferential seal between said opening perimeter and said vane extremity, the annular protrusion extending in an axial and tangential direction and being deflectable upon application of an axial or tangential load on the grommet by the vane extremity while maintaining said circumferential seal, and an annular restraint element radially spaced apart from said annular protrusion, the annular restraint element limiting at least axial and tangential displacement of said vane extremity relative to said shroud.

There is also provided a grommet for a gas turbine engine vane assembly including an annular shroud having a plurality of openings circumferentially spaced apart and a plurality of vanes each with an extremity received within a corresponding one of the openings, each of the openings receiving the grommet therein between each said vane and the annular shroud, the grommet comprising: an elongate portion receivable within the corresponding one of the openings and defining a radially extending bore along a central axis thereof adapted to receive the vane extremity therein, thereby shielding the vane extremity from the annular shroud, said elongate portion having formed therein an annular protrusion adapted to contact a perimeter of the corresponding one of the openings for forming an axial and tangential seal between said perimeter and the vane extremity, and an annular restraint element adjacent said protrusion and radially spaced apart therefrom, the restraint element limiting axial and/or tangential displacement of the elongate portion of the grommet and therefore of the vane extremity relative to the annular shroud.

BRIEF DESCRIPTION OF THE DRAWINGS

Further features and advantages of the present invention will become apparent from the following detailed description, taken in combination with the appended drawings, in which.

It will be noted that throughout the appended drawings, like features are identified by like reference numerals.

DETAILED DESCRIPTION

Figure 1:
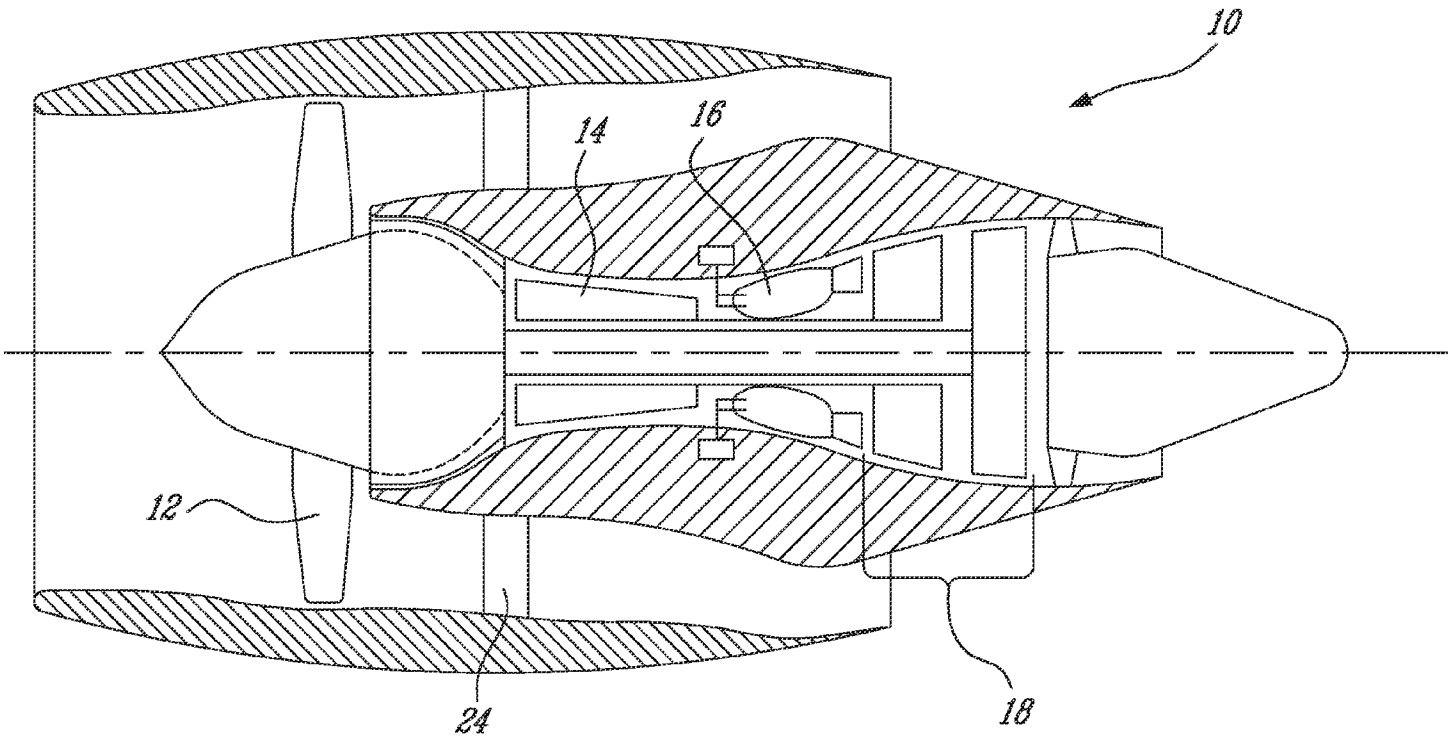
FIG. 1 is a schematic cross-sectional view of a gas turbine engine.

FIG. 1 illustrates a gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine 18 for extracting energy from the combustion gases.

Figure 2:
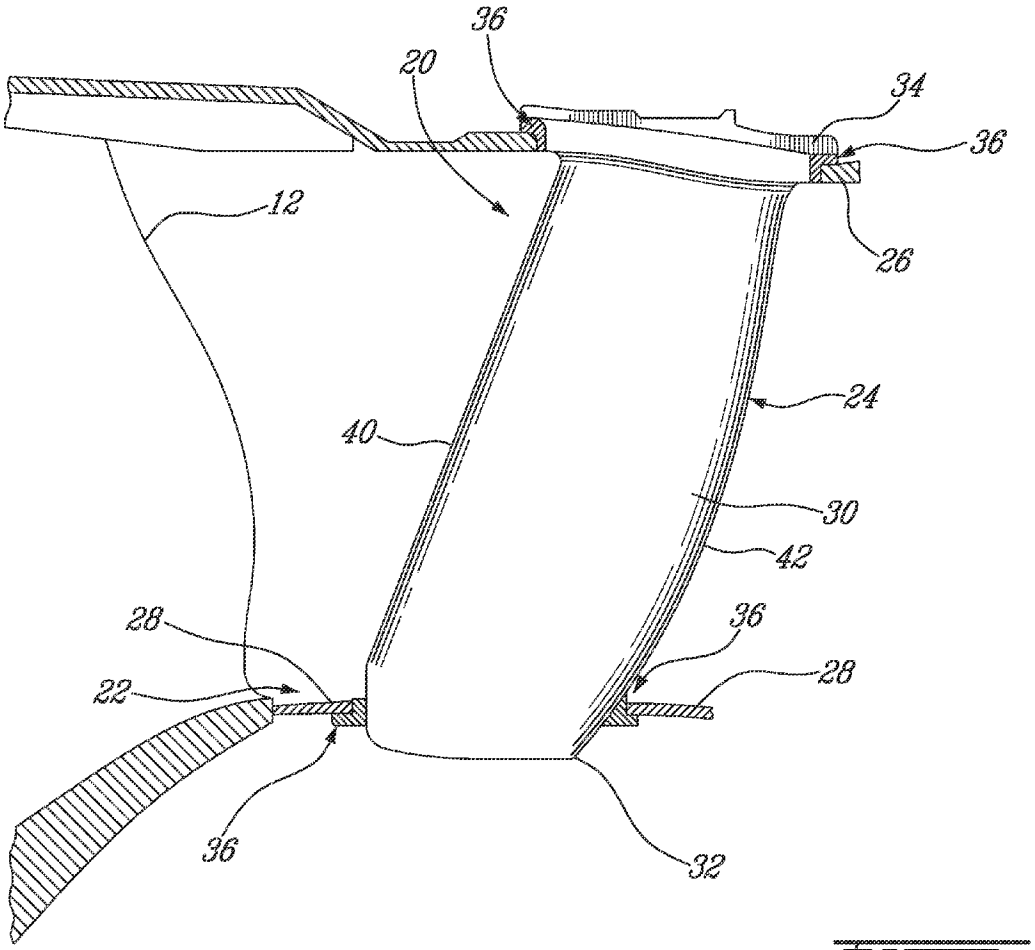
FIG. 2 is a cross-sectional view of a guide vane assembly of the engine of FIG. 1, according to an embodiment of the present disclosure.
Figure 3:
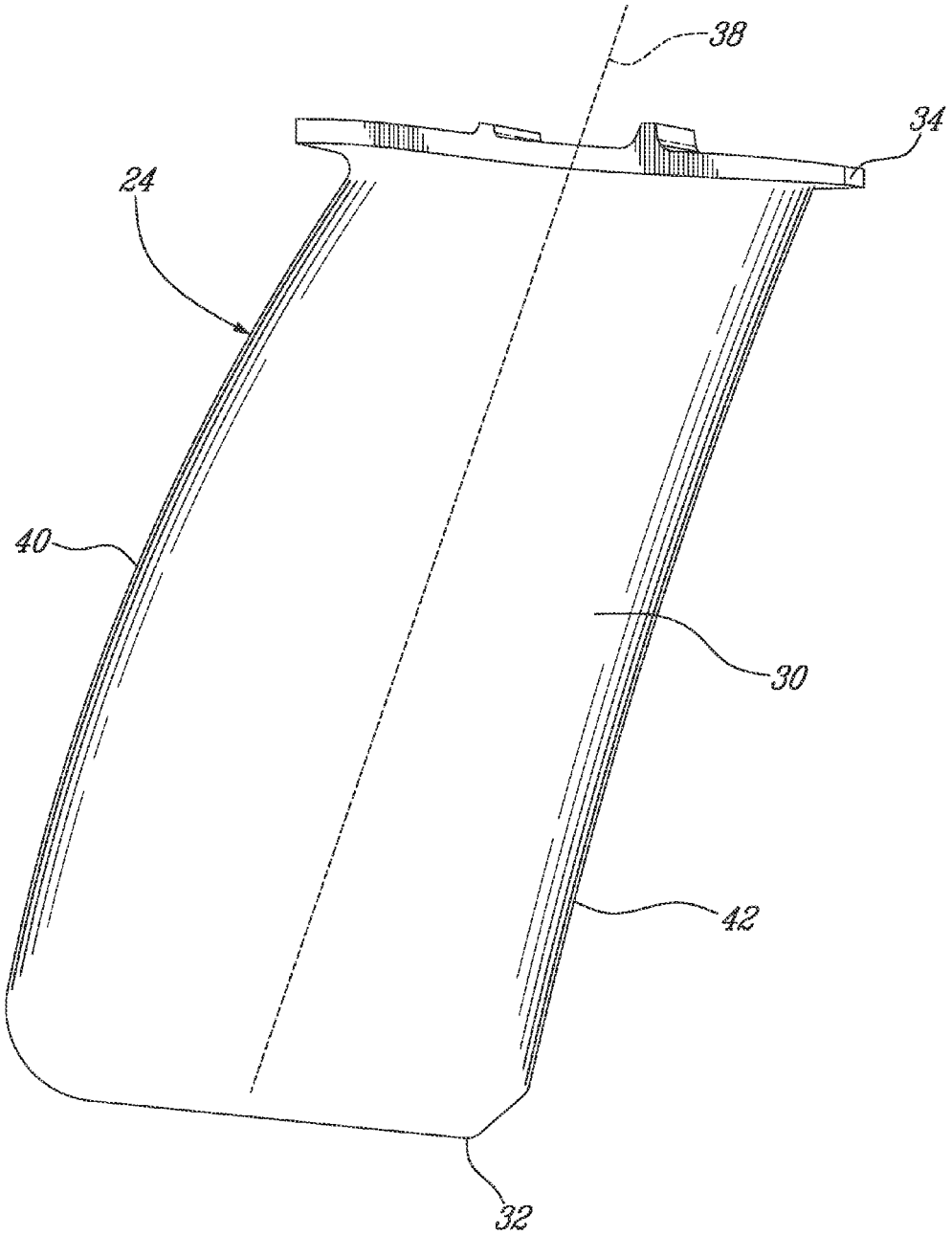
FIG. 3 is a perspective side view of a guide vane which is part of the assembly shown in FIG. 2.

Referring now to FIG. 2 and FIG. 3, the vane assembly 20, possibly but not necessarily a guide vane assembly, is located downstream of the fan 12. The vane assembly 20 includes an inner shroud 22 and a plurality of vanes 24 extending radially between the inner shroud 22 and an engine casing or an outer shroud 26. The inner shroud 22 includes a shroud ring 28 and each of the vanes 24 has an airfoil portion 30 extending between the vane tip 32 and the vane root 34. The vane root 34 is coupled to the outer shroud 26 and the vane tip 32 is coupled to the shroud ring 28. One or both of the vane root 34 and the vane tip 32 may be retained in a resilient grommet 36, inserted into one of a plurality of openings (not shown) respectively formed in the outer shroud 26 and in the shroud ring 28 and distributed about a circumference thereof for receiving therein the extremities of the radially extending vanes 24. The airfoil portion 30 of each vane 24, which has a longitudinal axis 38, defines a leading edge 40 and a trailing edge 42, such that an airflow passing through the vane assembly 20 will flow from the leading edge 40 to the trailing edge 42.

Throughout this description, the axial, radial and circumferential directions are defined respectively with respect to the central axis, radius and circumference of the outer shroud 26 or of the shroud ring 28 of the inner shroud 22, both the inner shroud 22 and the outer shroud 26 being concentric with the central longitudinal axis of the gas turbine engine, the inner shroud 22 being located inwardly of the outer shroud 26.

Figure 4:
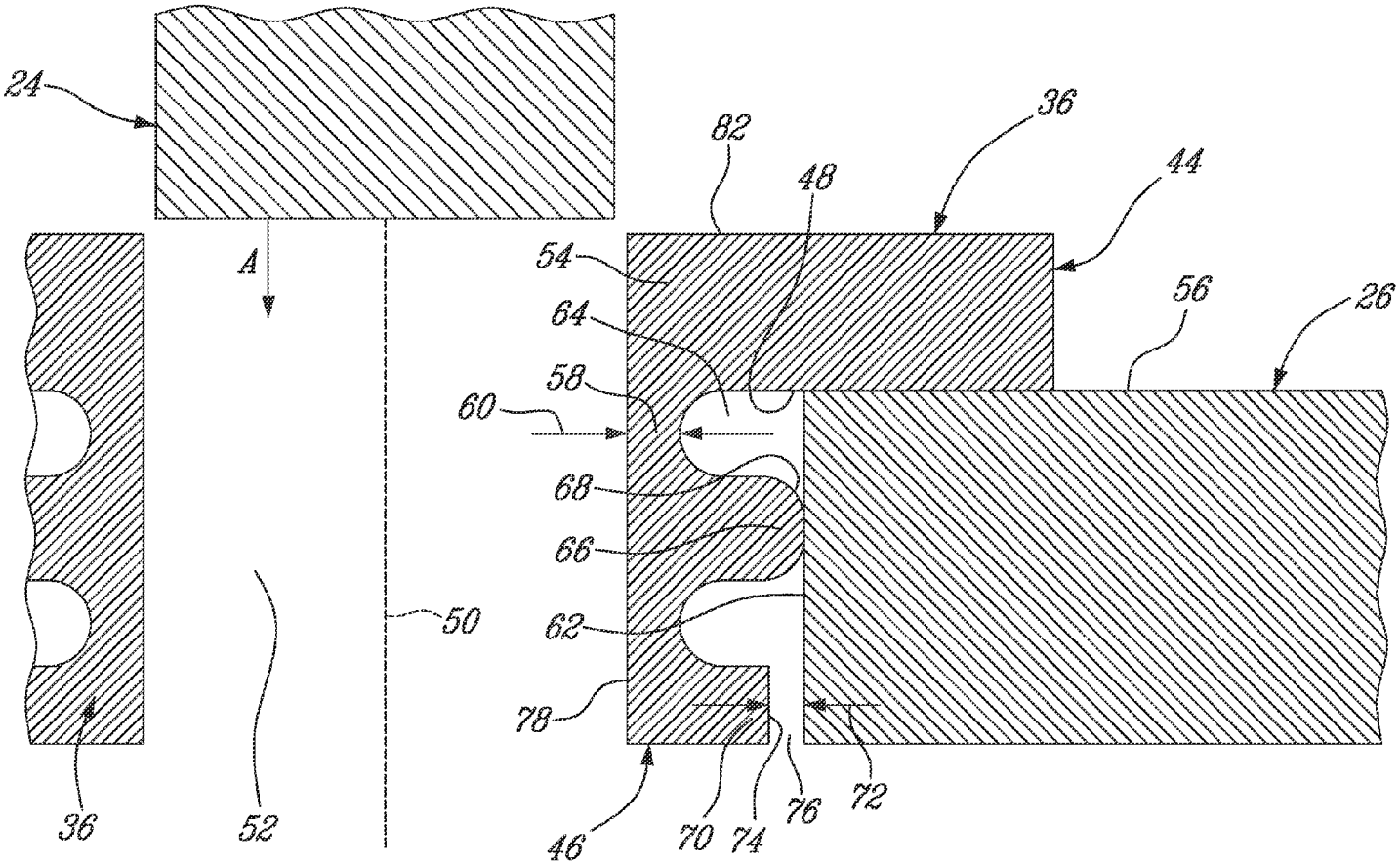
FIG. 4 is a partial cross-sectional view of a portion of the guide vane assembly, showing in detail the grommet thereof.
Figure 5:
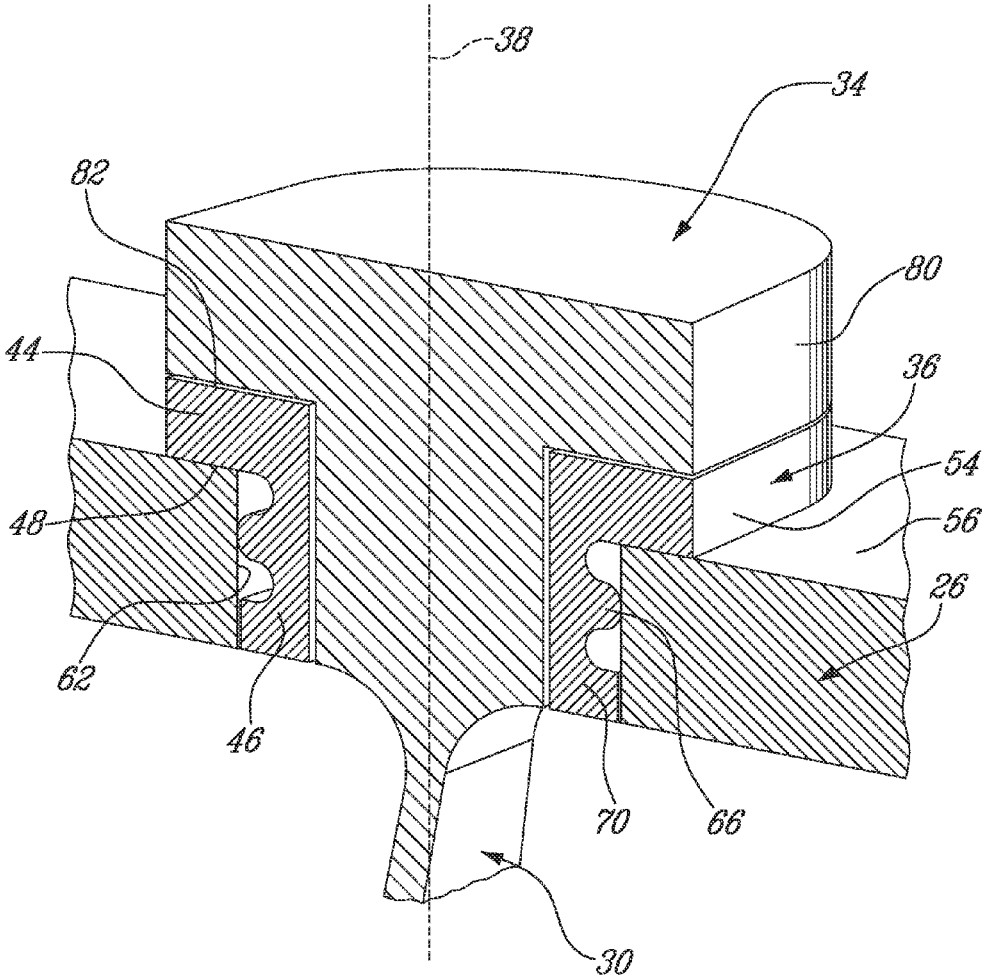
FIG. 5 is a perspective cross-sectional view of the guide vane assembly, showing the mated vane, grommet, and shroud ring of FIG. 4.

Referring to FIG. 4 and FIG. 5, each of the aforementioned grommets 36 may be made of a resilient material and finished with a smooth, flush surface so as not to protrude into the gas path. As will be described, the grommets 36 form a tight fit with the shroud opening within which they are disposed, and thereby provide a self-sealing grommet which seals without requiring any additional external radial force being applied, as was previously done to seal certain prior art grommets using a circumferentially extending strap wrapped about the outer periphery of the grommets in an outer vane shroud for example.

The grommet 36 illustratively comprises a first planar base portion 44 and a second elongated portion 46 extending away from a surface of the first portion 44 along a central axis 50 thereof, the plane of the first portion 44 being transverse to the central axis 50. It will be apparent that the orientation of the grommet 36 may be inverted depending on whether the grommet 36 is for retaining the vane root 34 or the vane tip 32. As illustrated in FIG. 4 and FIG. 5, when the grommet 36 is to be mated with the vane root 34, the second portion 46 of the grommet 36 extends from the lower surface 48 of the first portion 44. Alternatively, for mating with the vane tip 32, the grommet 36 is illustratively rotated by 180 degrees and, in this orientation, the lower surface 48 of the first portion 44 then becomes an upper surface thereof with the second portion 46 extending away therefrom. Thus, for illustration purposes, the upper and lower orientations are hereinafter defined with respect to a mating of the grommet 36 with the vane root 34.

An elongated, radially extending, bore 52 is illustratively defined through both the first portion 44 and the second portion 46 of the grommet 36 along the central axis 50. The bore 52 is adapted to receive therein the vane extremity, such as the vane root 34, as will be discussed herein below. The first portion 44 is formed as a retaining lip 54 having a lower surface, which is the lower surface 48 of the first portion 44, adapted to rest on an upper surface 56 of the outer shroud 26 when the grommet 36 is inserted into the corresponding opening formed in the outer shroud 26. In this manner, the grommet 36 is prevented from slipping through the opening when installed.

The second portion 46 of the grommet 36 may have formed therein, adjacent the first portion 44, a relatively thin neck portion 58. The axial and/or tangential thickness 60 of the neck portion 58 is such that, when the grommet 36 is positioned in the opening formed in the outer shroud 26, the neck portion 58 is circumferentially spaced apart from the wall 62 of the opening in the outer shroud 26 and an annular, axially and/or tangentially extending, gap or recess 64 is defined therebetween. Provision of the annular recess or gap 64 enables the grommet 36 to move away from the vane 24 and towards the shroud wall 62 during installation of the vane 24. In this manner, vane installation can be completed more safely and easily as such an axial deflection of the grommet 36 facilitates insertion of the vane 24 through the bore 52. The axial and tangential directions are referred to herein are understood, with reference to FIG. 4 for example, to respectively correspond to a fore-aft or left-to-right direction (i.e. axial) and to a direction extending into the page in FIG. 4 (i.e. tangential).

The second portion 46 of the grommet 36 further comprises an annular protrusion 66, defined outwardly of the neck portion 58 and which extends axially and/or tangentially. The protrusion 66 has a shape and configuration, which allows for some axial/tangential compliance, thus enabling slight deflection or bending of the protrusion 66 when making contact with the shroud wall 62 and/or when an axial or tangential load is applied to the grommet by the vane extremity. In particular, the small radial thickness of the protrusion 66 as well as provision of the neck portion 58 adjacent the protrusion 66 enable the latter to deflect for better axial sealing of the grommet 36 against the shroud wall 62. The protrusion 66 has an arcuate outer surface 68 adapted to frictionally engage the shroud wall 62 when the grommet 36 is in place. The grommet 36 then compressingly engages the shroud wall 62 in a tight fitting relationship once the vane 24 is inserted, thereby creating a seal about the circumference of the vane extremity, in both the axial and tangential directions. The protrusion 66 thus provides both axial and tangential sealed retention of the vane 24 when the latter is installed in the grommet 36, as will be discussed further herein below.

In order to maintain the positional control of the vane 24 relative to the outer shroud 26, an axial and/or tangential restraining element, such as an annular bumper, 70 is defined in the second portion 46 of the grommet 36 adjacent the protrusion 66. Similarly to the neck portion 58, the annular bumper 70 is spaced apart from the shroud wall 62 by a small annular gap 72 which is defined between the shroud wall 62 and an outer surface 74 of the bumper 70 for assembly purposes. The bumper, or restraint element, provides greater resistance to deformation than does the axial protrusion 66. In one embodiment, for example, the bumper 70 is stiffer than the protrusion 66, in order to provide this greater resistance to deformation. The bumper 70 has an outer surface 74 whose contact area is greater that that of the sealing surface 68, in order to achieve this greater stiffness and thus greater resistance to deformation. As such, the bumper 70 tends to restrain the vane 24, thus preventing excessive axial and tangential movement and limiting displacement of the vane. Improved rigidity of the vane 24 within the outer shroud 26 is therefore achieved. Although the stiffness of the bumper 70 is illustratively provided by the larger radial thickness of the latter relative to the radial thickness of the protrusion 66, such stiffness may also be achieved by attaching a reinforcement on the outer surface 74. Alternatively, the bumper 70 may be manufactured out of a denser material than the material used to manufacture the remaining elements of the grommet 36.

Still referring to FIG. 4 and FIG. 5, in assembly, the grommet 36 is illustratively first inserted into the opening 76 formed in the outer shroud 26 with the bottom surface 48 of the lip 54 abutting against the upper surface 56 of the outer shroud 26. In this position, the sealing surface 68 of the protrusion 66 contacts the shroud wall 62, thus sealingly engaging the perimeter of the opening 76 formed in the outer shroud 26. The vane 24 is then inserted into the opening 76 formed in the outer shroud 26. In particular, the vane 24 is inserted into the elongated bore 52 formed in the grommet 36 along a direction A, such that the longitudinal axis 38 of the vane 24 is aligned with the central axis 50 of the lip 54. As discussed herein above, the gap 64 enables deflection of the grommet 36 for facilitating positioning of the vane 24, and particularly of the vane root 34, within the bore 52. When so positioned, the vane root 34 makes contact with an inner wall 78 of the grommet 36 and is in frictional engagement therewith. The vane root 34 further comprises an end platform 80 sized greater than that the opening 76, such that the end platform 80 illustratively abuts on an upper surface 82 of the lip 54 and forms a radial seal therewith.

Such positioning of the vane root 34 (and/or vane tip 32) relative to the grommet 36 thus prevents axial, tangential and/or radial movement of the vane 24 beyond its predetermined position. Indeed, the cooperation between the lip 54 and neck portion 58, the protrusion 66, and the bumper 70 efficiently retains the vane tip 32 and/or vane root 34 in the axial and tangential directions, providing additional stability to the vane position. As such, the risk of rearward movement of the vane 24 upon impact of a foreign object is reduced. In particular, vibrations generated in the vanes 24 as a result of fluctuations imposed thereupon during operation typically lead to displacements of the vanes 24 in a direction transverse to the longitudinal axis 38. The grommet 36 advantageously damps such displacements by compression and extension thereof. This, in turn, reduces the risk of damage to the grommet 36 and adjacent components upon the impact of a foreign object.

Figure 6:
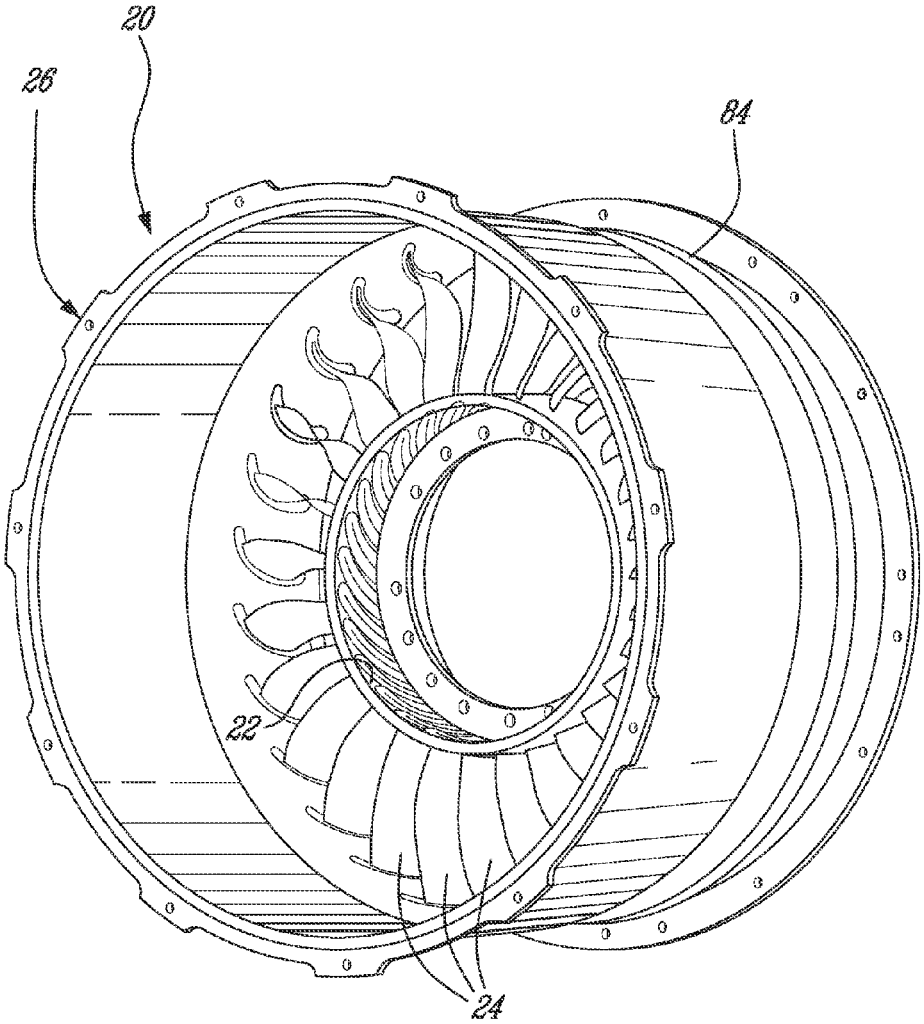
FIG. 6 is a perspective view of the guide vane assembly of FIG. 2.

Referring now to FIG. 6 in addition to FIG. 4 and FIG. 5, the vane assembly 20 eliminates the need for adhesives or the like to maintain the grommets 36 in place, which reduces costs and simplifies production and maintenance operations. In particular, each grommet 36 is self-sealing and ensures a tight fit between mating components during installation. As such, the grommet 36 alleviates the need for a radial load to be applied for sealing purposes. Although a retaining strap 84 may still be used to radially retain the vanes 24, thereby compressing the grommets 36 and maintaining the vanes 24 in sealed engagement with the outer shroud 26 and/or the shroud ring 28 of the inner shroud 22, there is no need to use high tension to provide a radial load on the grommets 36. Effective mounting of the vanes 24 to the inner shroud 22 and/or outer shroud 26 is therefore facilitated.

The above description is meant to be exemplary only, and one skilled in the art will recognize that changes may be made to the embodiments described without department from the scope of the invention disclosed. For example, the vane assembly 20 can be used for other types of turbine engine vanes or stators. The grommets 36 can therefore be used with other types of vanes. Still other modifications which fall within the scope of the present invention will be apparent to those skilled in the art, in light of a review of this disclosure, and such modifications are intended to fall within the appended claims.

The invention claimed is:

1. A vane assembly comprising:

an annular shroud having radially spaced apart inner and outer surfaces, said shroud having a plurality of openings extending between said inner and outer surfaces;

a plurality of vanes radially extending from said shroud, each vane having an extremity received within a corresponding one of said openings; and a grommet located within each of said openings between each of said vanes and said shroud, said grommet defining a radially extending bore along a central axis thereof adapted to receive said vane extremity therein, the grommet shielding said vane extremity from said shroud, said grommet having formed therein an annular protrusion in contact with a perimeter of said opening in the shroud to form a circumferential seal between said opening perimeter and said vane extremity, the annular protrusion extending in an axial and tangential direction and being deflectable upon application of an axial or tangential load on the grommet by the vane extremity while maintaining said circumferential seal, and an annular restraint element radially spaced apart from said annular protrusion, the annular restraint element extending in an axial and tangential direction a first distance, the first distance being less than a second distance in the axial and tangential direction defined between the radially extending bore of the grommet and the perimeter of the opening perimeter in the annular shroud such that the annular restraint element is spaced apart from, and not in contact with, the opening perimeter of the annular shroud during normal operation of the vane assembly, the annular restraint element limiting at least axial and tangential displacement of said vane extremity relative to said shroud.

2. The vane assembly of claim 1, wherein said grommet has an annular recess formed therein adjacent said annular protrusion, the recess extending circumferentially about the grommet and being spaced apart from said opening perimeter in said shroud for enabling at least one of an axial and tangential deflection of said grommet relative to said vane extremity.

3. The vane assembly of claim 1, wherein, when the load applied on the grommet is sufficient to deflect the annular protrusion, the restraint element abutting the opening perimeter to limit axial and/or tangential displacement of the vane extremity.

4. The vane assembly of claim 1, wherein a circumferential thickness of said protrusion is greater than that of the restraint element.

5. The vane assembly of claim 1, wherein the grommet includes an annular lip extending along a plane substantially transverse to said central axis of said grommet.

6. The vane assembly of claim 5, wherein said annular lip is adapted to abut a surface of said annular shroud, thereby retaining said grommet radially in place relative to said annular shroud.

7. The vane assembly of claim 6, wherein said vane extremity is a vane root including an end platform having a perimeter greater than said opening perimeter in the shroud, said end platform of the vane root abutting a surface of said annular lip, thereby forming a radial seal between said annular shroud and said vane root.

8. The vane assembly of claim 1, wherein said protrusion has a radial thickness smaller than that of said restraint element.

9. The vane assembly of claim 1, wherein the restraint element provides greater resistance to deformation than does the protrusion.

10. The vane assembly of claim 9, wherein said restraint element is stiffer than the protrusion.

11. The vane assembly of claim 1, wherein said shroud is an outer shroud and said vane extremity is a root of said vane.

12. The vane assembly of claim 1, wherein said grommet is made of a resilient material.

13. The grommet of claim 1, wherein a circumferential thickness of said protrusion is greater than that of the restraint element.

14. A grommet for a gas turbine engine vane assembly including an annular shroud having a plurality of openings circumferentially spaced apart and a plurality of vanes each with an extremity received within a corresponding one of the openings, each of the openings receiving the grommet therein between each said vane and the annular shroud, the grommet comprising:

an elongate portion receivable within the corresponding one of the openings and defining a radially extending bore along a central axis thereof adapted to receive the vane extremity therein, thereby shielding the vane extremity from the annular shroud, said elongate portion having formed therein an annular protrusion adapted to contact a perimeter of the corresponding one of the openings for forming an axial and tangential seal between said perimeter and the vane extremity, and an annular restraint element adjacent said protrusion and radially spaced apart therefrom, the annular restraint element extending in an axial and tangential direction a first distance, the first distance being less than a second distance in the axial and tangential direction defined between the radially extending bore of the grommet and the perimeter of the corresponding one of the openings in the annular shroud such that the annular restraint element is spaced apart from, and not in contact with, said perimeter during normal operation of the vane assembly, the restraint element limiting axial and/or tangential displacement of the elongate portion of the grommet and therefore of the vane extremity relative to the annular shroud.

15. The grommet of claim 14, further comprising an annular lip extending along a plane substantially transverse to said central axis of the grommet, said annular lip being adapted to abut a surface of the shroud when the grommet is placed in the corresponding one of the openings, thereby retaining the grommet in place relative to the shroud.

16. The grommet of claim 14, wherein said elongate portion has formed therein, adjacent said protrusion, a recessed portion circumferentially spaced from said perimeter of the corresponding one of the openings for enabling an axial and/or tangential deflection of the grommet relative to the vane extremity when positioning the vane extremity in the grommet.

17. The grommet of claim 14, wherein said protrusion has a radial thickness smaller than a radial thickness of said restraint element.

18. The grommet of claim 14, wherein, when the load applied on the grommet is sufficient to deflect the protrusion, the restraint element abutting the opening perimeter to limit axial and/or tangential displacement of the vane extremity.

* * * * *